US006899001B1

(12) United States Patent
Sanders et al.

(10) Patent No.: US 6,899,001 B1
(45) Date of Patent: May 31, 2005

(54) FIREFIGHTER'S WRENCH

(76) Inventors: Alan Sanders, 4722 N. Henney Rd., Choctaw, OK (US) 73020; Shane Campbell, 5721 Valley Way, Oklahoma City, OK (US) 73150

( * ) Notice: Subject to any disclaimer, the term of this patent is extended or adjusted under 35 U.S.C. 154(b) by 0 days.

(21) Appl. No.: 10/929,068

(22) Filed: Aug. 27, 2004

Related U.S. Application Data

(60) Provisional application No. 60/499,945, filed on Sep. 3, 2003.

(51) Int. Cl.[7] ..... B25B 13/10
(52) U.S. Cl. ..... 81/176.3; 81/176.15; 81/125
(58) Field of Search ..... 81/176.3, 176.15, 81/176.2, 155, 157, 164, 125, 125.1, 60

(56) References Cited

U.S. PATENT DOCUMENTS

| | | | | |
|---|---|---|---|---|
| 489,107 | A | 1/1893 | Storz | |
| 1,413,798 | A | 4/1922 | Shinn | |
| 1,465,009 | A * | 8/1923 | Wasseth | 81/437 |
| 1,763,353 | A | 6/1930 | Heller | |
| 3,662,630 | A | 5/1972 | Baxter | |
| D263,674 | S | 4/1982 | Ebert | |
| 4,554,944 | A * | 11/1985 | Daghe et al. | 137/296 |
| 4,690,019 | A | 9/1987 | Daghe | |
| 5,247,715 | A | 9/1993 | Nishiguchi | |
| 5,255,576 | A | 10/1993 | Keith | |
| D360,118 | S | 7/1995 | Stanepher | |
| 5,428,853 | A | 7/1995 | Menke | |
| 5,632,301 | A * | 5/1997 | Julicher | 137/296 |
| 6,102,444 | A | 8/2000 | Kozey | |
| 6,220,124 | B1 * | 4/2001 | Perkins | 81/174 |
| 6,298,754 | B1 | 10/2001 | Brown | |
| 6,520,051 | B1 * | 2/2003 | Hu | 81/60 |

OTHER PUBLICATIONS

Wrenches and Axes; www.chiefsupply.com/axes.phtml p. 2 of 4.

Wrenches Page; www.firequip.com/wrenches.htm pp. 1 and 2.

* cited by examiner

*Primary Examiner*—Joseph J. Hail, III
*Assistant Examiner*—Alvin J Grant
(74) *Attorney, Agent, or Firm*—Rondal D. Homburg

(57) ABSTRACT

A multiple component wrench is adapted for use to attach and disconnect fire hose and hydrant coupling using this singular tool in lieu of several tools currently used by firefighters. The wrench has a sliding portion and a receiver portion presented as one tool, yet allowing multiple wrenches adapted for use on Storz and spanner hose couplings, rocker lug couplings, water meter shutoff valves, gas cock valves, pentagonal nuts and square nuts, and includes a multiple ratchet mechanism with multiple removable ratchets adapted to a variety of different nuts encountered on the multiple hydrants installed in various municipalities. The wrench is also extendable to provide additional leverage during use, the wrench further capable of separation forming two independent wrenches.

8 Claims, 5 Drawing Sheets

FIREFIGHTER'S WRENCH

CROSS REFERENCE TO RELATED APPLICATIONS

This application claims benefit of Provisional Patent Application No. 60/499,945 filed on Sep. 3, 2003.

I. BACKGROUND OF THE INVENTION

1. Field of Invention

A multiple component wrench is adapted for use to attach and disconnect fire hose and hydrant coupling using this singular tool in lieu of several tools currently used by firefighters. The wrench has a sliding portion and a receiver portion presented as one tool, yet allowing multiple wrenches adapted for use on Storz and spanner hose couplings, rocker lug couplings, water meter shutoff valves, gas cock valves, pentagonal nuts and square nuts, and includes a multiple ratchet mechanism with multiple removable ratchets adapted to a variety of different nuts encountered on the multiple hydrants installed in various municipalities. The wrench is also extendable to provide additional leverage during use, the wrench further capable of separation forming two independent wrenches.

2. Description of Prior Art

The following United States patents were discovered and are disclosed within this application for utility patent. All relate to wrenches and tools adapted to be used with hydrants and firefighting equipment and hoses. U.S. Pat. No. D263,674 to Ebert, discloses a combination hydrant spanner and a lug wrench for use on a fire hydrant. Numerous other combination wrenches adapted to firefighting use also were disclosed in several utility patents listed below.

U.S. Pat. No. 6,298,754 to Brown is a tool which has a pipe wrench on one end and a spanner wrench on the other end. It does not have a rachet means, an adjusting length handle and is not adapted to any other hose and hydrant fittings. In U.S. Pat. No. 6,220,124 to Perkins, a fire hydrant wrench is disclosed which does include an adjustable length handle, but it does not contain any devices used for hose couplings. It also discloses a chatter-thread arrangement that permits the handle to be pushed, rather than manually threaded, into engagement with the fire hydrant fixture.

Another fireman's tool assembly, disclosed in U.S. Pat. No. 5,428,853 to Menke, having a spike member slidably engaged with a wrench member used as a slide hammer to drive the spike, the wrench member having a universal adjustable wrench fitting to open and close hydrant valves, the spike member and wrench member also having three hose coupling jaws, or a spanner extension adapted to hose couplings, the spike member and wrench member being separable so that the spanner extensions may be used independently, such spanner extensions or "jaws" provided in three different sizes, but not of the sane size, to fit a variety of hose couplings. A universal ratcheting fire hydrant wrench is disclosed in U.S. Pat. No. 5,255,576 to Keith. Other combination fire hydrant wrenches are also found in U.S. Pat. No. 5,247,715 to Nishiguchi, U.S. Pat. No. 4,690,019 to Daghe, and U.S. Pat. No. 1,763,353 to Heller.

In U.S. Pat. No. 489,107 to Storz, and U.S. Pat. No. 6,102,444 to Kozey, a hose coupling is disclosed, which has been named by those skilled in the art as a "Storz" coupling, and has given rise to wrenches which are referenced in the art as a Storz wrench. See attached advertising literature from on-line catalogues at www.fireguip.com/wrenches.htm, and www.chiefsupply.com.

None of the disclosed prior art patents disclose a single adjustable length tool which includes a Storz wrench and a spanner wrench on each opposing end of the tool, with a sliding member having a shaft with a water main cutoff and an opposing first tool end having a commercial gas valve slot and a ratchet mechanism including a spring engaging pawl and a plurality of replaceable ratchet cylinders, each cylinder having a different fitting cut-out portion, and a receiver member having a slide channel and a second end including a universally adjustable compression wrench, the shaft of the sliding member slidably engaged within the slide channel of the receiver member and retained by a shaft locking means which allows the tool to be used in a closed position, an extended position or a complete separation of the sliding member and receiver member for use a two separate tools required to couple or uncouple hose fittings.

II. SUMMARY OF THE INVENTION

At the present time, when a firefighter arrives at the scene of a fire, he is often presented with several different couplings which require a special tool, several nuts requiring a special tool and several hydrants and valves which require special tools. At present, a firefighter may be required to carry multiple heavy tools to a location to be prepared for what is present for use at a scene, each scene being different from the next.

The current wrench provides a singular tool adapted for nearly every possible valve, coupling, nut and hydrant currently used in fire hydrants and fire hoses. It has multiple wrenches, slots, multiple ratchets inserting within a socket including a pawl, and provides the user with two pieces which may be separated for use as two independent wrenches when coupling and disconnecting a fire hose.

The primary objective of the wrench is to provide a single tool to be carried to a scene adapted to all couplings, nuts, valves and hydrants, which may be adapted as two independent tools. A second objective is to provide the tool in an extendable wrench to allow for additional leverage when needed. A third objective is to provide the wrench with an overall collapsed length under 22 inches, to fit within the tool box within most fire trucks.

III. DESCRIPTION OF THE DRAWINGS

The following drawings are submitted with this utility patent application.

FIG. 6 is an upper cross sectional view of the ratchet housing, the ratchet wheel and the spring loaded ratchet pawl engaging the plurality of ratchet teeth.

IV. DESCRIPTION OF THE PREFERRED EMBODIMENT

Figure 1:
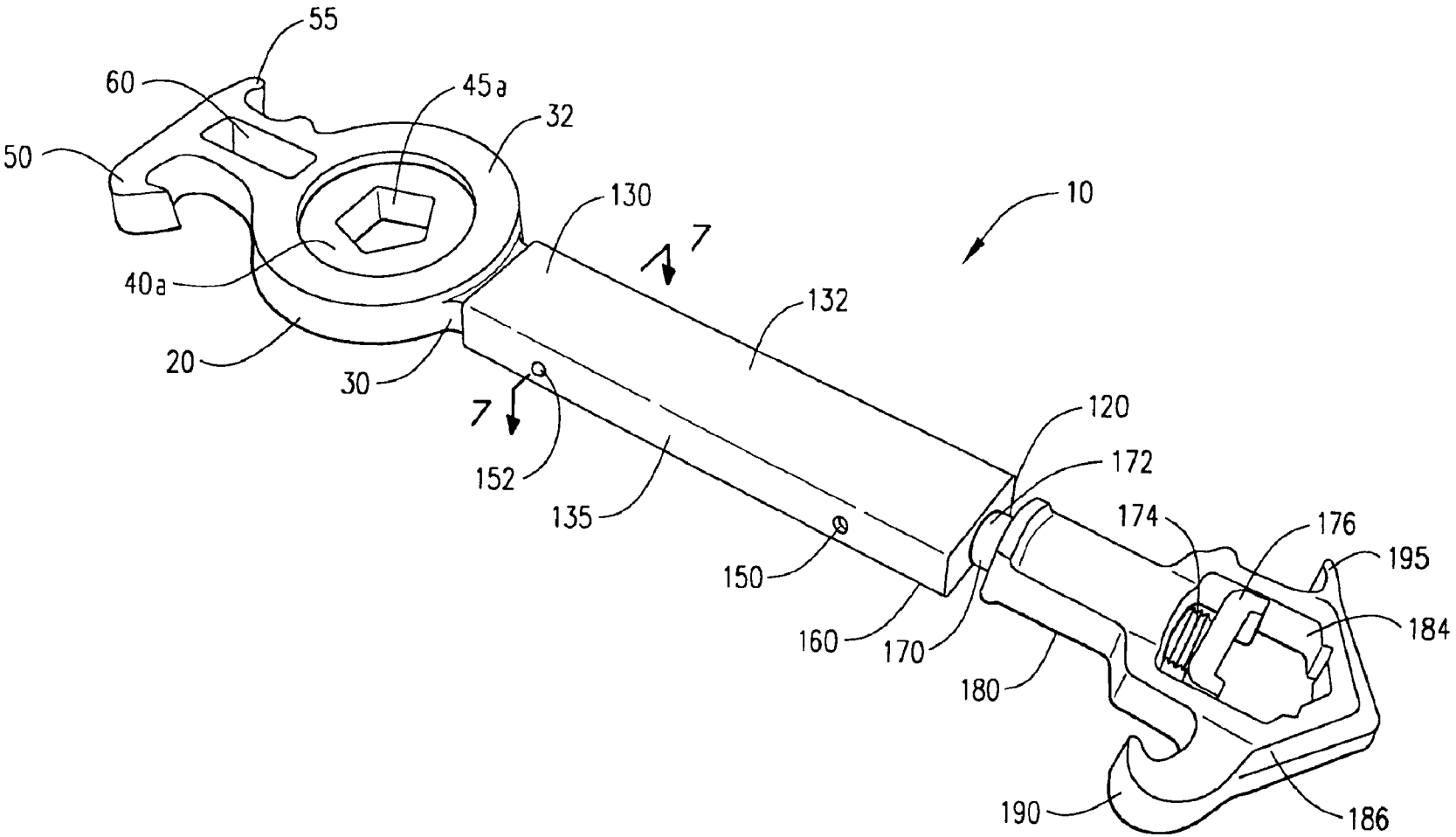
FIG. 1 is an upper perspective view of the tool in a closed position.
Figure 2:
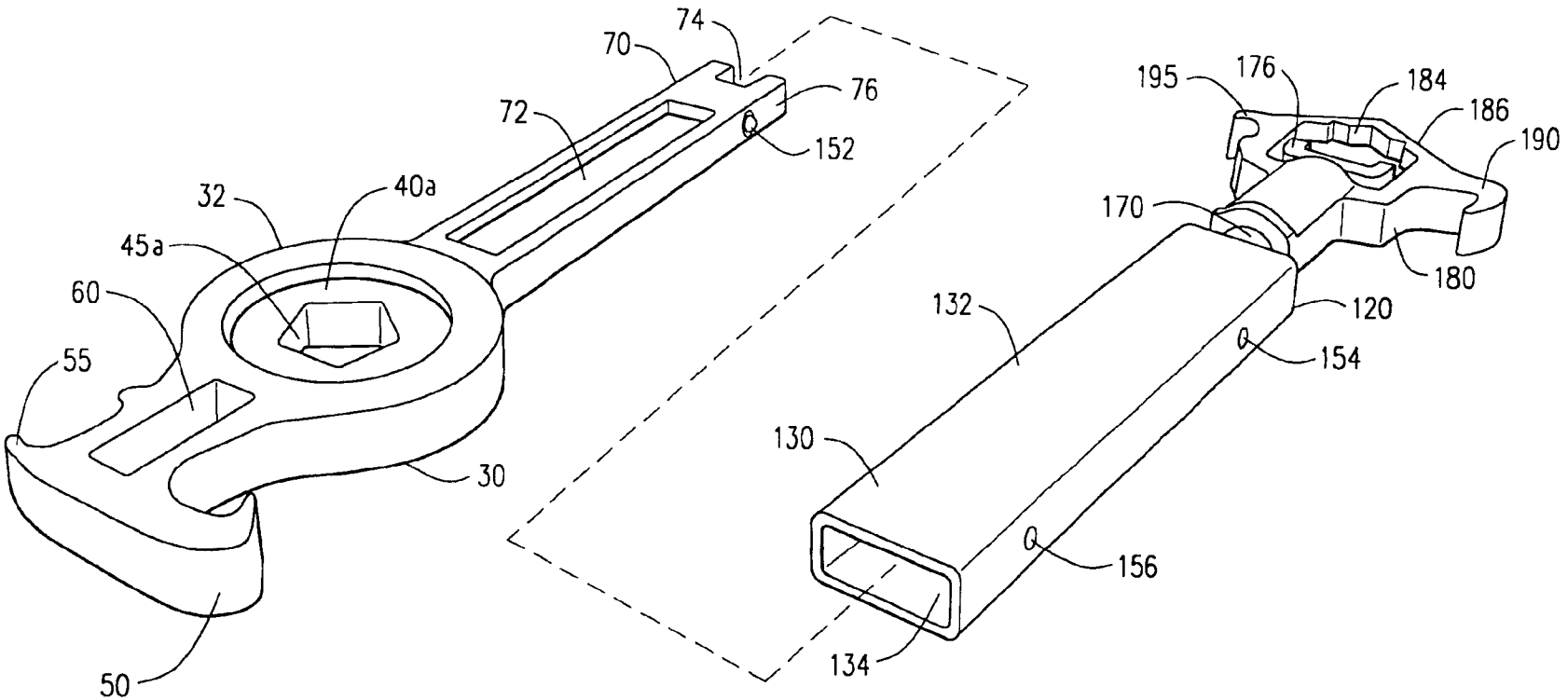
FIG. 2 is an upper perspective view of the tool with the sliding member and the receiver member separated.
Figure 3:
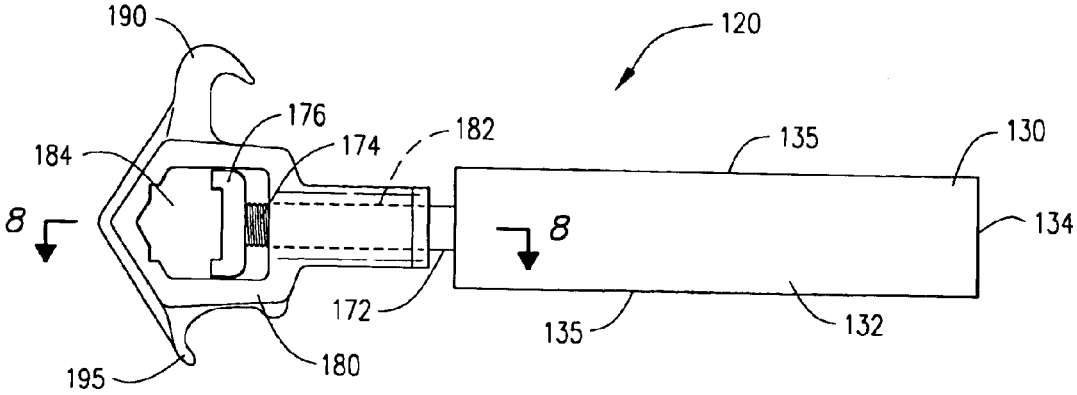
FIG. 3 is an upper view of the sliding member.
Figure 4:
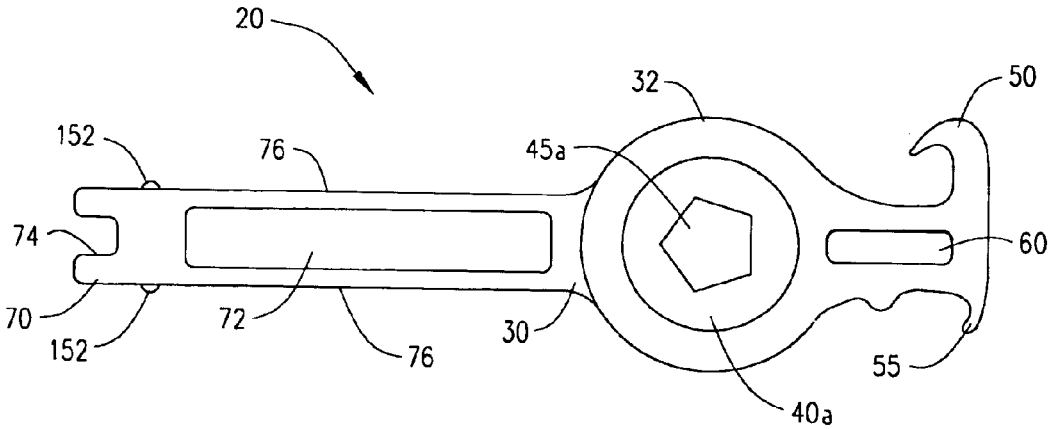
FIG. 4 is an upper view of the receiver member.
Figure 7:
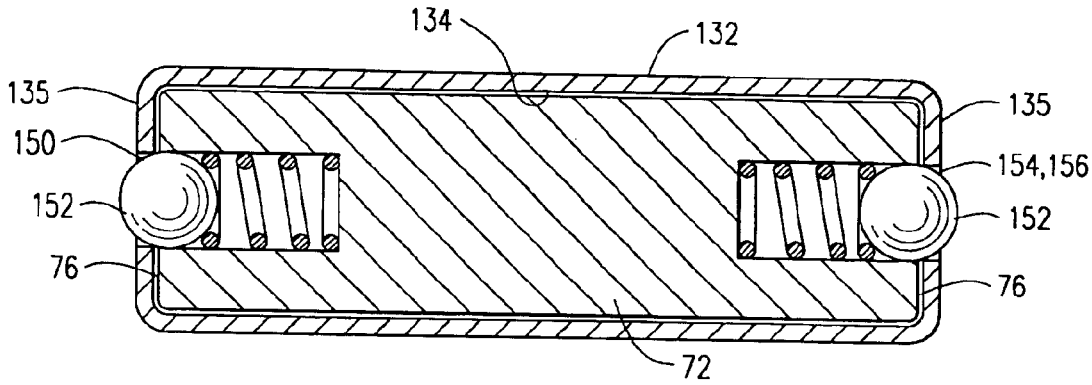
FIG. 7 is a cross-sectional view along section lines 7/7 of FIG. 1, showing the shaft within the shaft receiver channel and the shaft locking means.
Figure 8:
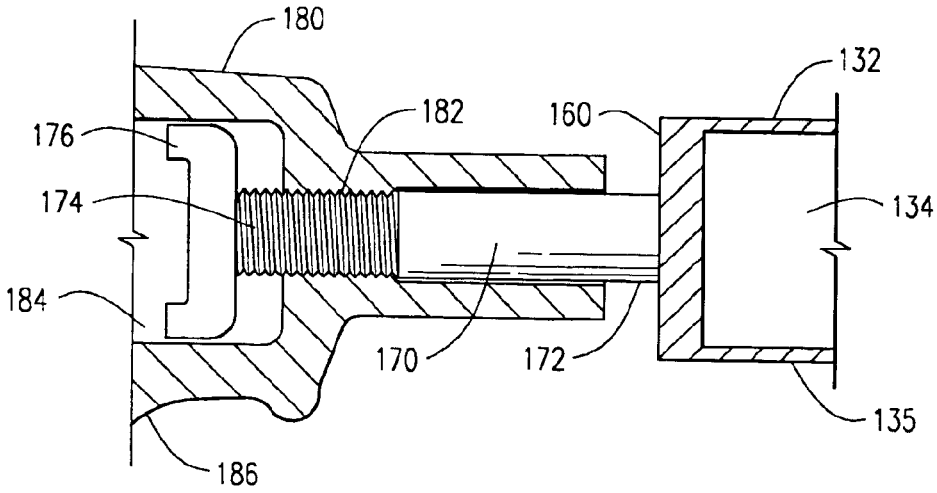
FIG. 8 is a cross-sectional view of the second tool end of the receiver member along section line 8/8 of FIG. 3, showing the externally threaded extension attached to the internally threaded throat of the spark resistant housing defining the internal universal socket and the lock plate.

A wrench tool 10, shown in FIGS. 1–8 of the drawings, for use in firefighting, providing a plurality of tools used by firemen on hydrants and hose couplings, replacing several other individual tools used for the same purpose, the wrench tool 10 comprising a sliding member 20, FIG. 4, having a first tool end 30 defining a ratchet housing 32 within which one of a multiplicity of cylindrical ratchet wheels 40*a*, 40*b* having a plurality of outer ratchet teeth 42*a*, 42*b* and an interior geometric cut-out portion 45*a*, 45*b* may be retained, said ratchet housing 32 further providing a pawl housing 34 containing a spring loaded ratchet pawl 35 engaging the ratchet teeth 42*a*, 42*b* to restrict rotation of the ratchet wheel 40*a*, 40*b* to one direction, FIG. 6, said ratchet housing 32 further providing a first spanner wrench 50 adapted to a Storz coupler, a slotted channel 60 adapted to a commercial gas cock, and a second spanner wrench 55, adapted to rocker lug couplings, said sliding member 20 having a second end 70 defining a shaft 72 terminating with a vertical slot 74 adapted for a water main cut-off, and a receiver member 120, FIG. 3, having a first end 130 defining a shaft receiver channel 132 with an inner cavity 134 within which the shaft 72 of the sliding member 20 is received and retained by a shaft locking means 150, FIG. 7, said shaft 72 and shaft receiver channel 132 sliding together allowing for a closed position and an extended position between the sliding member 20 and the receiver member 120 for additional leverage to the tool 10, said receiver member 120 further comprising a second tool end 160 attaching a first end 172 of an externally threaded extension 170 upon which is threadably engaged an internally threaded throat 182 of a spark resisting housing 180 defining an internal universal socket 184, FIG. 8, the threaded extension 170 having a second end 174 to which is applied a lock plate 176, the lock plate 176 applied within the internal universal socket 184 adapting the universal socket 184 and lock plate 176 to a hydrant nut of a variety of shapes, said spark resisting housing 180 further having an outer margin 186 to which is applied a third spanner wrench 190 adapted to a Storz coupling and a fourth spanner wrench 195 adapted to rocker lug couplings, the sliding member 20 and the receiver member 120 being separable to provide the firefighter with two independent and identical sets of spanner wrenches 50, 55, 190, 195 to engage and disengage common hose and hydrant couplings.

The first spanner wrench 50 and third spanner wrench 190 are best adapted to 4–5 inch Storz couplings found on larger fire hose couplings, while the second spanner wrench 55 and fourth spanner wrench 195 are adapted to 2.5 inch rocker lug couplings commonly found on smaller fire hose couplings. By having like spanner wrenches on each end of the tool 10, the tool 10, when separated, FIG. 2, may be used on each side of a fire hose coupling to tighten and loosen the fire hoses at a fire scene without having to use multiple tools.

Figure 5A:
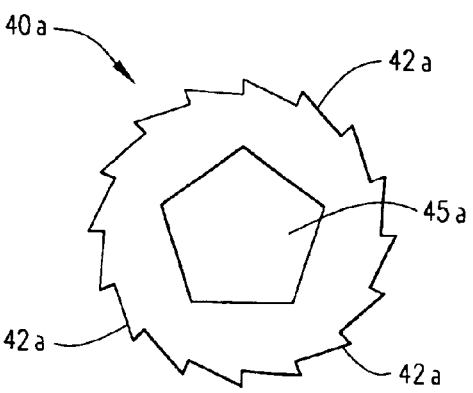
FIGS. 5A and 5B are upper views of a first and second embodiment of the ratchet wheel.
Figure 5B:
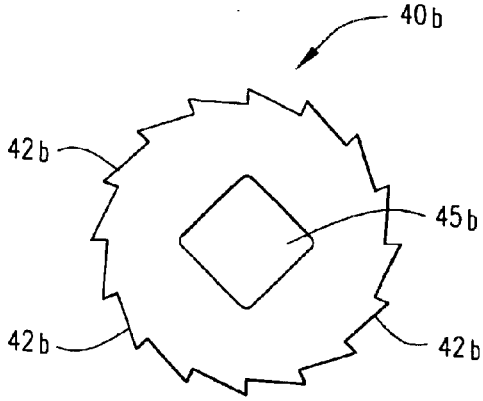
Figure 5:
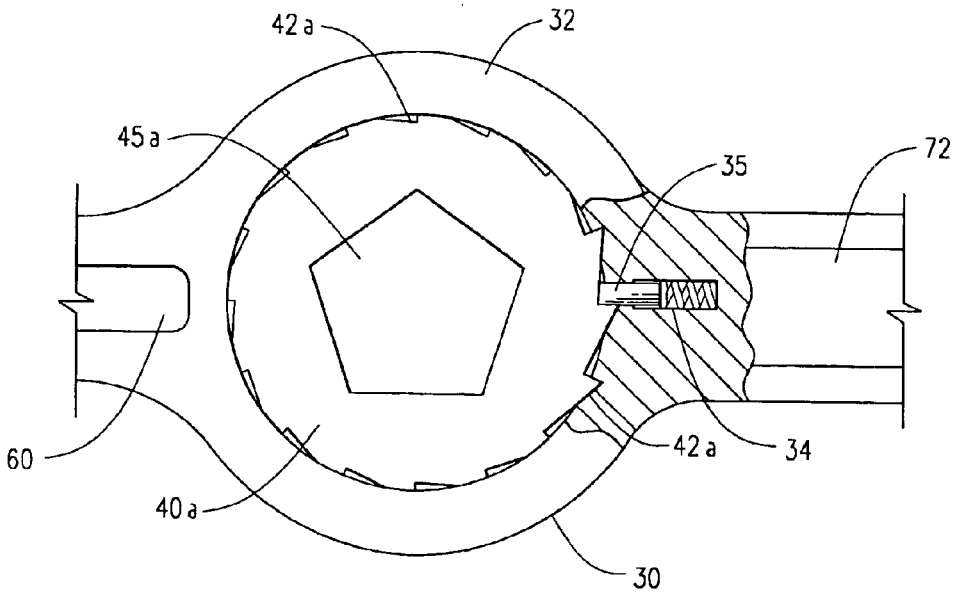

The internal universal socket 184, FIGS. 5A, 5B and 6, within the spark resisting housing 180 is adapted specifically to pentagonal and square nuts commonly found on most fire hydrants. As there are several different types of fire hydrants, even within the same municipality at times, the internal universal socket 184 should be configured to adapted to several different sizes and shapes of hydrant nuts. Therefore, the shape of the internal universal socket 184, shown in FIGS. 5A, 5B and 6 of the drawings, would be most preferable. The spark resisting housing 180, by rotation along the externally threaded extension 170, forces the lock plate 176 within the internal universal socket 184, reducing and enlarging the area of universal internal socket 184 allowing for the tightening of the second tool end 160 upon a hydrant nut to loosen the hydrant nut, regardless of the shape of the hydrant nut.

The shaft locking means 150, shown in FIG. 7 of the drawings, is provided in one embodiment as a pair of recessed locking spheres 152 along lateral edges 76 of the shaft 72, with at least two matching pair of locking holes 154, 156 in lateral edges 135 of the shaft receiver channel 132, a first pair of locking holes 154 near the first end 130 of the receiver member 120 engaging the pair of recessed locking spheres 152 providing the tool 10 in the extended position, and second pair of locking holes 156 on the shaft receiver channel 132 adjacent to the second tool end 160, providing the tool 10 in the closed position. Other shaft locking means may be provided, although not shown, including intermediate positions between the closed and extended positions of the tool.

More specifically, the spring-loaded ratchet pawl 35 is retained within the pawl housing 34, allowing the spring-loaded pawl 35 to retract within the pawl housing 34. As the outer ratchet teeth 42*a*, 42*b* of the cylindrical ratchet wheel pass over the spring-loaded pawl 35 in one direction, the spring-loaded pawl 35 retracts within the pawl housing 34, allowing each outer ratchet tooth to pass, the spring-loaded pawl 35 immediately springing upward to engage the next outer ratchet tooth, preventing counter rotation, locking the cylindrical ratchet wheel 40*a*, 40*b* into a fixed position.

The best suited number of the plurality of outer ratchet teeth 42*a*, 42*b* on the cylindrical ratchet wheels 40*a*, 40*b* is at least eight equally spaced teeth, but most preferably would be sixteen teeth, FIGS. 5A, 5B and 6, which reduces the impact forces upon the outer ratchet teeth 42*a*, 42*b* and the spring-loaded ratchet pawl 35. Each cylindrical ratchet wheel 40*a*, 40*b* turns in one direction only, limited by the spring loaded ratchet pawl 35, which allows each cylindrical ratchet wheel 40*a*, 40*b* to be applied to tighten the hydrant nut when applied on one side, and loosen the hydrant nut when the tool 10 is applied on the opposing side. The geometric cut-out portions 45*a*, 45*b* would be provided in the size and shape most commonly encountered with hydrant nuts, which are square 45*a*, FIG. 5A or pentagonal 45*b*, FIG. 5B, or may be provided in other shapes not shown.

While the invention has been particularly shown and described with reference to a preferred embodiment thereof, it will be understood by those skilled in the art that changes in form and detail may be made therein without departing from the spirit and scope of the invention.

What is claimed is:

1. A wrench tool for use in firefighting, providing a plurality of tools used by firemen on hydrants and hose couplings, replacing several other individual tools used for the same purpose, said wrench tool comprising:

a sliding member having a first end forming a ratchet housing containing at least one cylindrical ratchet wheel having outer ratchet teeth engaged by a spring loaded pawl retained within a formed pawl housing in said ratchet housing, said cylindrical ratchet wheel having a cut-out portion adapted to a hydrant nut, said first end also forming a first spanner wrench adapted to a Storz coupler, a slotted channel adapted to a commercial gas cock, and a second spanner wrench adapted to pin and rocker lug couplings, said sliding member also having a second end forming a shaft; and a receiver member having a first end providing a shaft receiver channel defining an interior cavity, said shaft receiver channel receiving said shaft of said sliding member with a shaft locking means retaining said shaft within said shaft receiver channel, said receiver member further comprising a second tool end attached to a first end of an externally threaded extension upon which an internally threaded throat of a spark resistant housing is threadably engaged, said externally threaded extension having a second end to which is applied a lock plate, retaining said spark resisting housing upon said externally threaded extension, said spark resisting housing defining an internal universal socket adapted to a hydrant nut with an outer margin forming a third spanner wrench adapted to a Storz coupling and a fourth spanner wrench adapted to pin and rocker lug couplings, said sliding member and said receiver member being separable to provide a firefighter with two independent and identical sets of spanner wrenches to engage and disengage common hose and hydrant couplings.

2. The tool, as disclosed in claim 1, wherein said first spanner wrench and third spanner wrench are best adapted to 4–5 inch Storz couplings found on larger fire hose couplings, while the second spanner wrench and fourth spanner wrench are adapted to 2.5 inch rocker lug couplings commonly found on smaller fire hose couplings, thus providing like spanner wrenches on each end of said tool, when separated, to be used on each side of a fire hose coupling to tighten and loosen the fire hoses at a fire scene using said single tool.

3. The tool, as disclosed in claim 1, wherein said universal housing is adapted to a variety of different sizes and shapes of hydrant nuts by providing said spark resisting housing, upon rotation along said externally threaded extension, forcing said lock plate within said internal universal socket, to loosen or tighten said hydrant nut, regardless of said shape of said hydrant nut.

4. The tool, as disclosed in claim 1, wherein said shaft locking means further comprises:

a pair of recessed locking spheres along lateral edges of said shaft; and at least two matching pair of locking holes in lateral edges of said shaft receiver channel, a first pair of locking holes near said first end of said receiver member engaging said pair of recessed locking spheres providing said tool in an extended position, and second pair of locking holes on said shaft receiver channel adjacent to said second tool end, providing said tool in a closed position.

5. A wrench tool for use in firefighting, providing a plurality of tools used by firemen on hydrants and hose couplings, replacing several other individual tools used for the same purpose, said wrench tool comprising:

a sliding member having a first tool end defining a ratchet housing within which one of a multiplicity of cylindrical ratchet wheels having a plurality of outer ratchet teeth and an interior geometric cut-out portion may be retained, said ratchet housing further providing a pawl housing containing a spring loaded ratchet pawl engaging said ratchet teeth to restrict rotation of said ratchet wheel to one direction, said ratchet housing further providing a first spanner wrench adapted to a Storz coupler, a slotted channel adapted to a commercial gas cock, and a second spanner wrench adapted to rocker lug couplings, said sliding member having a second end defining a shaft terminating with a vertical slot adapted for a water main cut-off, and a receiver member having a first end defining a shaft receiver channel with an inner cavity within which said shaft of said sliding member is received and retained by a shaft locking means, said shaft and shaft receiver channel sliding together allowing for a closed position and an extended position between said sliding member and said receiver member for additional leverage to said tool, said receiver member further comprising a second tool end attaching a first end of an externally threaded extension upon which is threadably engaged an internally threaded throat of a spark resisting housing defining an internal universal socket, said threaded extension having a second end to which is applied a lock plate, said lock plate applied within said internal universal socket adapting said universal socket and lock plate to a hydrant nut of a variety of shapes, said spark resisting housing further having an outer margin to which is applied a third spanner wrench adapted to a Storz coupling and a fourth spanner wrench adapted to rocker lug couplings, said sliding member and said receiver member being separable to provide a firefighter with two independent and identical sets of spanner wrenches to engage and disengage common hose and hydrant couplings.

6. The tool, as disclosed in claim 5, wherein said first spanner wrench and third spanner wrench are best adapted to 4–5 inch Storz couplings found on larger fire hose couplings, while the second spanner wrench and fourth spanner wrench are adapted to 2.5 inch rocker lug couplings commonly found on smaller fire hose couplings, thus providing like spanner wrenches on each end of said tool, when separated, to be used on each side of a fire hose coupling to tighten and loosen the fire hoses at a fire scene using said single tool.

7. The tool, as disclosed in claim 5, wherein said universal housing is adapted to a variety of different sizes and shapes of hydrant nuts by providing said spark resisting housing, upon rotation along said externally threaded extension, forcing said lock plate within said internal universal socket, to loosen or tighten said hydrant nut, regardless of said shape of said hydrant nut.

8. The tool, as disclosed in claim 5, wherein said shaft locking means further comprises:

a pair of recessed locking spheres along lateral edges of said shaft; and at least two matching pair of locking holes in lateral edges of said shaft receiver channel, a first pair of locking holes near said first end of said receiver member engaging said pair of recessed locking spheres providing said tool in said extended position, and second pair of locking holes on said shaft receiver channel adjacent to said second tool end, providing said tool in said closed position.

* * * * *